US005475788A

United States Patent [19]

Classens et al.

[11] Patent Number: 5,475,788

[45] Date of Patent: Dec. 12, 1995

[54] RADIATION FIXING DEVICE WITH NATURAL CONVECTION AIRFLOW

[75] Inventors: Wilhelmus P. J. Classens, Castenray; Dries G. Drewes, Geldrop; Josef G. H. Peeters, Tegelen; Laurentius W. J. M. Messing, deceased, late of Boxtel, all of Netherlands, by P. C. L. M. Messing - Josiassen, legal representative

[73] Assignee: OCE'-Nederland, B.V., Netherlands

[21] Appl. No.: 111,560

[22] Filed: Aug. 25, 1993

[30] Foreign Application Priority Data

Sep. 4, 1992 [NL] Netherlands ..... 9201545

[51] Int. Cl.[6] ..... G03G 15/20

[52] U.S. Cl. ..... 392/417; 219/388; 219/216; 355/286

[58] Field of Search ..... 219/216, 388; 392/417; 355/286, 285, 288; 34/273, 274, 620, 266

[56] References Cited

U.S. PATENT DOCUMENTS

| | | | |
|---|---|---|---|
| 1,916,810 | 7/1933 | Schmidt | 219/388 |
| 3,726,023 | 4/1973 | Geyken et al. | 34/273 |
| 4,075,455 | 2/1978 | Kitamura et al. | 219/216 |
| 4,088,868 | 5/1978 | Zeuthen . | |
| 4,202,112 | 5/1980 | Eltz et al. | 34/266 |
| 4,317,026 | 2/1982 | Koblo et al. | 219/216 |
| 4,367,037 | 1/1983 | Nishikawa . | |
| 4,686,351 | 8/1987 | Nakauchi | 219/216 |
| 4,981,434 | 1/1991 | Arndt | 432/59 |

FOREIGN PATENT DOCUMENTS

| | | | |
|---|---|---|---|
| 54-99639 | 8/1979 | Japan | 219/216 |
| 2177187 | 1/1987 | United Kingdom | 392/417 |

*Primary Examiner*—John A. Jeffery
*Attorney, Agent, or Firm*—Birch, Stewart, Kolasch & Birch

[57] ABSTRACT

A radiation fixing device for fixing a powder image on a sheet with the aid of heat-radiating lamellae which extend on both sides of a horizontal sheet conveyor path, the heat-radiating lamellae being situated in a housing having slot-shaped openings through which a sheet is fed into and led out of the housing. Air flow openings are provided in the base of the housing for automatically activating an air flow through the housing by means of natural convection, in areas adjacent to a sheet moving through the housing.

3 Claims, 7 Drawing Sheets

RADIATION FIXING DEVICE WITH NATURAL CONVECTION AIRFLOW

BACKGROUND OF THE INVENTION

1. Field of the Invention

The present invention relates to an electrophotographic imaging system and, more specifically, to a fixing device for fixing a powder image developed on a support by means of radiant heat during the electrophotographic imaging process.

2. Discussion of Related Art

A fixing device for an electrophotographic imaging process is disclosed in U.S. Pat. No. 4,088,868 in which a radiation fixing device is described which has a heat radiating energy source above the conveyor path and an air duct beneath the conveyor path. A forced air flow can be locally activated in the air duct by means of a continuously working air extractor. For that purpose, temperature detectors are placed at various points in the housing which are each connected to air valves located in the air duct at points corresponding to one of the temperature detectors, making a connection between the air duct and the air extractor in response to a temperature detected by the temperature detector. In addition to the need for having a continuously working air extractor, the known device also has the disadvantage that the more points there are for controlling the temperature, the more temperature detector/air valve combinations are necessary, which makes for a complicated and expensive construction.

SUMMARY OF THE INVENTION

Therefore, it is an object of the present invention to provide a fixing device for an electrophotographic imaging system which will overcome the above noted disadvantages.

It is a further object of the present invention to provide a new and useful radiant heat fixing device for electrophotographic imaging.

The foregoing objects and others are accomplished in accordance with the present invention, generally speaking, by providing a radiant energy fixing device for fixing a powder or toner image formed on the surface of a support member. The image fixing device provides the source of radiant heat for fusing the powder image. The image support member passes through a conveyor path which extends in a horizontal direction through the fixing device. The radiant heat fixing device includes a housing containing heat radiators, having two slot-shaped openings which are disposed at opposite ends of the fixing device opposite each other and between which the conveyor path extends. An air duct is formed in the housing and extends across the width of the conveyor path, serving to remove heat from the housing as air flows through the air duct. The air duct forms a fixed open connection between, on the one hand, an air inflow opening formed in the housing and situated at a level lower than at least one of the slot-shaped openings and, on the other hand, the same higher slot-shaped opening. Consequently, the air flow rises as a result of natural convection, which makes an air extractor or other mechanical air displacement device unnecessary. In addition, a support which moves through the fixing device via the conveyor path interrupts the air flow so that heat extraction via the air flow almost exclusively takes place in areas adjacent to the support, in which areas due to the lack of heat extraction via the support, more heat is present.

In a particularly preferred embodiment of a device according to the present invention, at least one of the heat radiators is located in the air duct, surrounded by flowing air. As a result, the heat transfer of this heat radiator to a support moving through the fixing device becomes more effective since, in addition to heat transfer by radiation, heat transfer also occurs by convection. In this way, a lower temperature of the heat radiators is sufficient for fixing a powder image on a support.

In a further preferred embodiment of the fixing device according to the present invention, the heat radiator located in the air duct is connected to an external energy source. As a result, the effective heat output from this heat radiator continues Unrestrained during the transport of a support through the fixing device. A restriction of the heat output would occur only if the heat radiator(s) above the conveyor path was/were connected to an external energy source.

In another embodiment of a device according to the present invention, a heat radiator located in the air duct comprises a number of heat emitting lamellae which are disposed at a short distance from one another and extend alternately in two planes which are at different distances from the conveyor path. As a result and in combination with natural convection from the air flowing through the housing, a very effective heat extraction takes place adjacent to a support moving through the housing.

BRIEF DESCRIPTION OF THE DRAWINGS

The invention will hereinafter be explained with reference to a number of embodiments in the accompanying drawings wherein.

DETAILED DISCUSSION OF THE INVENTION

Figure 1:
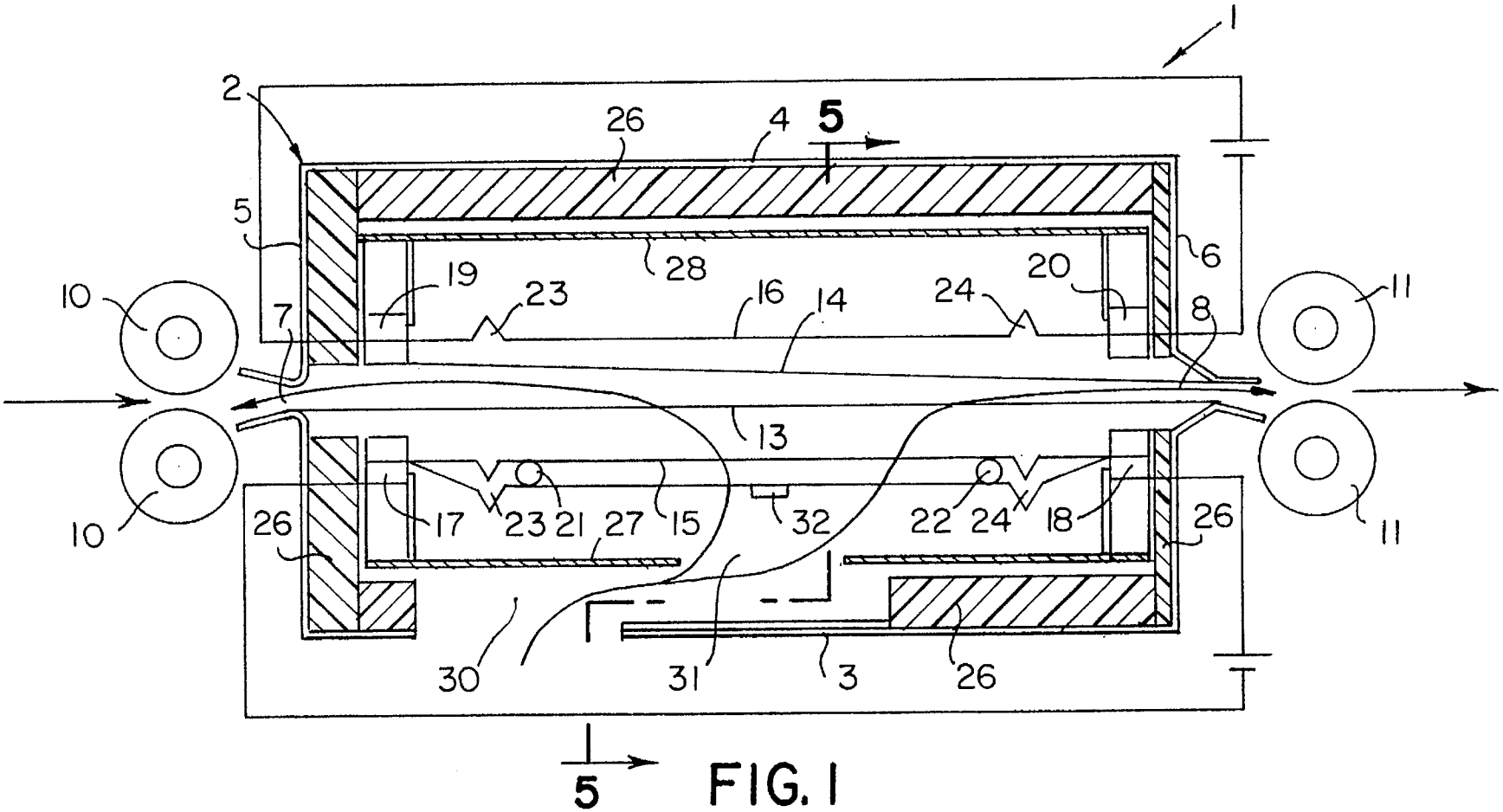
FIG. 1 is a section of a first embodiment of a radiation fixing device according to the present invention.

The radiation fixing device shown in FIG. 1 is formed by a box shaped housing 1 with external walls forming a guard 2 with a horizontal underside 3, a horizontal upper side 4 and four vertical side walls. In two opposite vertical side walls 5 and 6 of the guard 2 are located slot-shaped openings 7 and 8 respectively which extend across the whole width of the side walls at a point half-way up or midway between the side walls 5 and 6, having a width of about 6 mm and a length of about 900 mm. Outside the housing 1 and close to the slot-shaped openings 7 and 8, conveyor rollers 10 and 11 are respectively provided for feeding a support or sheet with an electrophotographically produced powder image thereon through a conveyor path in the housing 1. The conveyor path in the housing 1 is formed by sheet guide wires 13 and 14 which stretch respectively under and over the conveyor path between the side walls 5 and 6 in a direction so as to form an acute angle with the direction of transport of the sheet through the housing 1. The distance between the wires 13 and 14 is greater at the slot-shaped opening 7 where a sheet enters the housing 1 than at the slot-shaped opening 8 where the sheet leaves the housing. The sheet guide wires 13 and 14 are made of 0.4 mm thick stainless steel. Lamellae 15 are disposed beneath the sheet guide wires 13 which form the underside of the sheet conveyor path, and form a lower radiator, and lamellae 16 are provided above the sheet guide wires 14 which form the upper side of the sheet conveyor path, and form an upper radiator. The lamellae 15 and 16 consist of 9 mm wide and 0.05 mm thick strips of stainless Cr.Ni steel in which grooves having a width of 1 mm are formed. The sides of the lamellae 15 and 16 facing one another are sprayed black with a layer of heat-resistant varnish.

Adjacent lamellae in the lower and upper radiators are fixed at the ends in ceramic blocks 17, 18 and 19, 20, respectively, which are situated inside the side walls 5 and 6. Glass rods 21 and 22 having a diameter of about 6 mm are disposed between the lamellae of the lower radiator and near their ends, to keep the lamellae of the lower radiator alternately in two planes which lie at different distances from the sheet conveyor path. The distance between the lower and upper radiators is approximately 25 mm. The lamellae 15 and 16 are connected in series in order to achieve an electrical resistance in both lower and upper radiators of about 20 ohms when cold and 24 ohms when warm. Each lamella possesses two V-shaped depressions 23 and 24 for mounting each lamella with such a mechanical bias that it does not bow upon extension caused by a rise of temperature. The protective guard 2 is fitted on the inside with a layer of heat-insulating material 26. A heat-reflecting plate, 27 and 28 respectively, made of 1 mm thick reflective aluminum, is fitted beneath the lower radiator and above the upper radiator.

A row of twenty round holes 30 having a diameter of about 40 mm is formed in the underside 3 of the housing 1 and near to the slot-shaped opening 7 where a sheet enters, the holes being placed at regular intervals from one another. A row of 23 square holes 31, each having sides of about 32 mm is provided in the heat-reflecting plate 27 half-way between the side walls 5 and 6 and also at regular intervals from one another. A temperature detector 32 in the form of a Ni—CrNi thermocouple fixed centrally in the housing to a lamella of the lower radiator on a side away from the conveyor path, serves to regulate the energy supply to the radiators. Since the single temperature detector 32 is placed centrally in the housing 1, namely at a point along which all sheets pass, when central sheet feeding occurs, temperature regulation of the radiators functions irrespective of the width of the sheets fed through the radiation fixing device. When a sheet narrower than the working width of the radiation fixing device is fed through the center of the device, temperature regulation remains substantially the same as when a sheet is fed through, which is as wide as the working width of the radiation fixing device. Since a wider sheet fed through at the same speed absorbs more heat and removes more heat from the radiation fixing device than a narrower sheet, given an equal energy supply to the radiators, more heat will remain in the housing than when a narrower sheet is fed through. This excess heat occurs on both sides of the narrower sheet with the result that the temperature there can increase to a higher level than the temperature recorded by the temperature detector 32 at the center of the housing 1. As a result of the holes 30 and 31 which have been made, the relatively warm air at points where a sheet does not close off the slot-shaped openings 7 and 8 can escape from the housing as a result of natural convection and be replaced by relatively cold air entering via holes 30 and 31.

It has been found that with the radiation fixing device shown in FIGS. 1 and 5 the temperature of the radiators can be regulated to a level at which a powder image will be fixed onto normally used receiving material, for example at 270° C., and at which the temperature outside those areas of the fixing device touched by a sheet, remains clearly below a level which may not be exceeded for reasons of fire safety, for example 325° C. With a radiator output of 1500 W and a sheet transport speed of 3 m/min, it takes 15 seconds after being switched on for the radiation fixing device shown in FIGS. 1 and 5 to reach a situation at which the radiator temperature is 250° C. and a sheet of receiving material of 75 gram/m$^2$ fed through reaches a temperature which is sufficient for fixing a powder image.

Without natural convection via holes 30 and 31 on the underside of the housing i and slot-shaped openings 7 and 8, achieved by blocking the holes 30, when sheets 420 mm wide are fed centrally, a temperature of approximately 400° C. is recorded on the sides in the housing 1, which is in excess of the self-combustion temperature of paper which is determined to be 375° C. With natural convection via holes 30 and 31 and notably output slot 8, when all other conditions correspond, the same fixing situation is already reached at a radiator temperature of 220° C. as that reached without natural convection only at a radiator temperature of 250°. Clearly, heat from convection contributes to heating the sheet to a temperature necessary for the fixing process. For a receiving material of 110 gram/m$^2$, the radiator temperatures are 300° C. without convection and 260° C. with natural convection. In addition, the radiator temperature at the sides in the housing 1 remains less than 335° C. when narrow sheets of 75 gram/m$^2$ are fed through and the temperature of the radiators is regulated to 250° C. and less than 400° C. when narrow sheets of 100 gram/m$^2$ are fed through and the temperature of the radiators is regulated to 270° C.

When forced convection is applied by using a ventilator to blow air through holes 30, a higher maximum radiator temperature is measured on the sides in the housing 1 than when natural convection is applied. With forced convection, when 420 mm wide receiving material of 110 gram/m$^2$ is fed through and the temperature is regulated to 275° C., a maximum radiator temperature of over 380° C. is measured on the sides, whereas with natural convection under the same conditions, a 20 C lower maximum radiator temperature is measured at the sides in the housing. In addition, when glass rods 21 and 22 between the lower radiator lamellae are absent, a higher maximum radiator temperature is measured on the sides. Clearly, at points of the radiation fixing device according to the invention not touched by the receiving material, there is better heat extraction on account of the larger discharge surface with the lamellae 15 being staggered alternately. The temperature to which the radiators need to be regulated with the aid of the temperature detector 32 in a warmed-up fixing device is approximately 250° C. for processing a 110 gram/m$^2$ receiving material with a relative humidity of 20% and approximately 300° C. for that with a relative humidity of 80%. The maximum temperature of parts of the fixing device not touched by the receiving material is 320° C.

Figure 5:
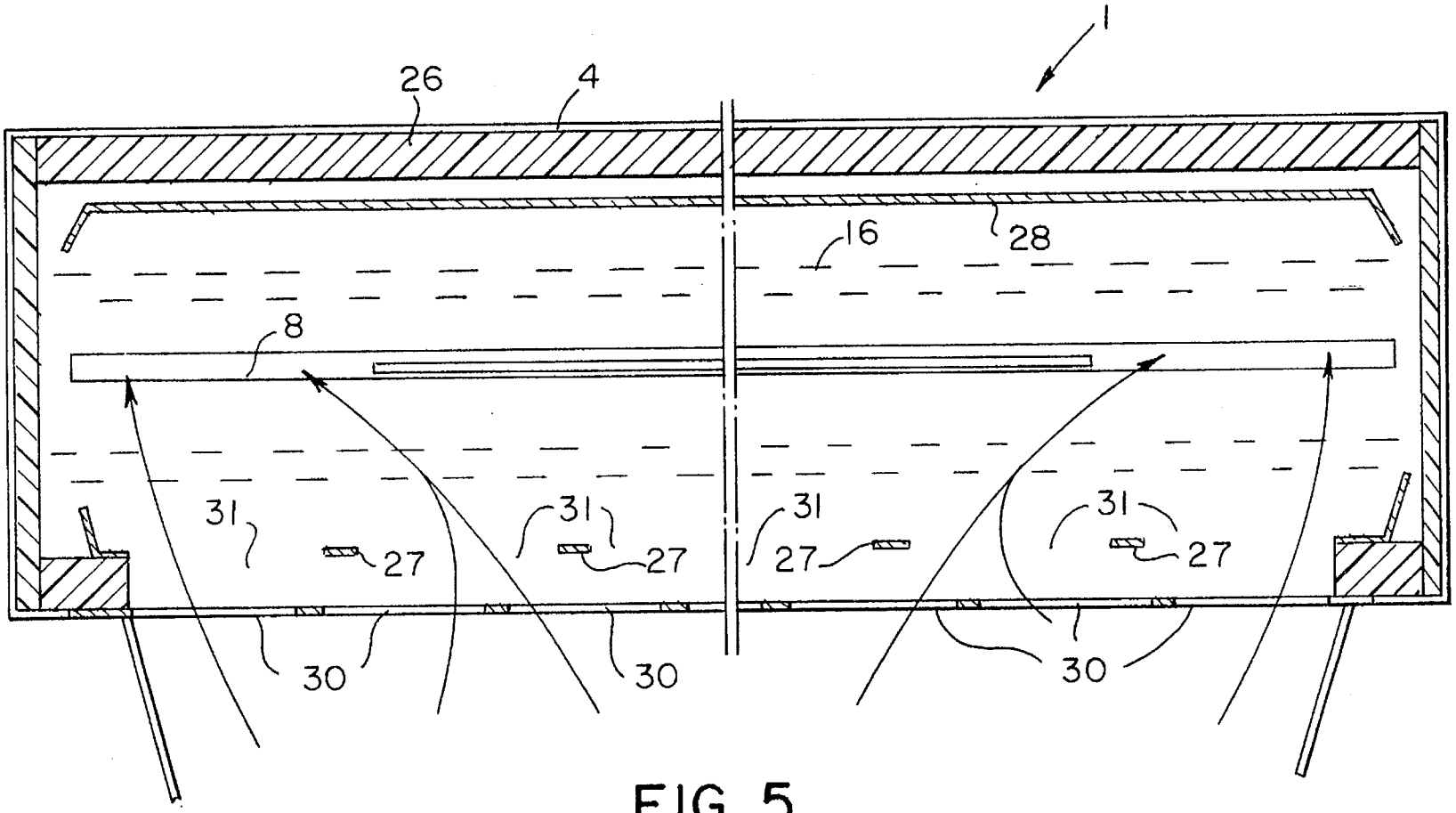
FIG. 5 is a cross-sectional view taken along broken line V—V of FIG. 1.

When the still cold radiation fixing device shown in FIGS. 1 and 5 is switched on, the temperature to which the radiators have to be regulated for processing 110 gram/m$^2$ receiving material with a relative humidity of 20% is approximately 275° C., approximately 25° C. higher therefore than in a warmed-up fixing device. The maximum temperature of parts of the fixing device not touched by receiving material is in this case approximately 360° C., lower therefore than the minimum temperature of 375° C. at which self-combustion of the receiving material is found.

Figure 2:
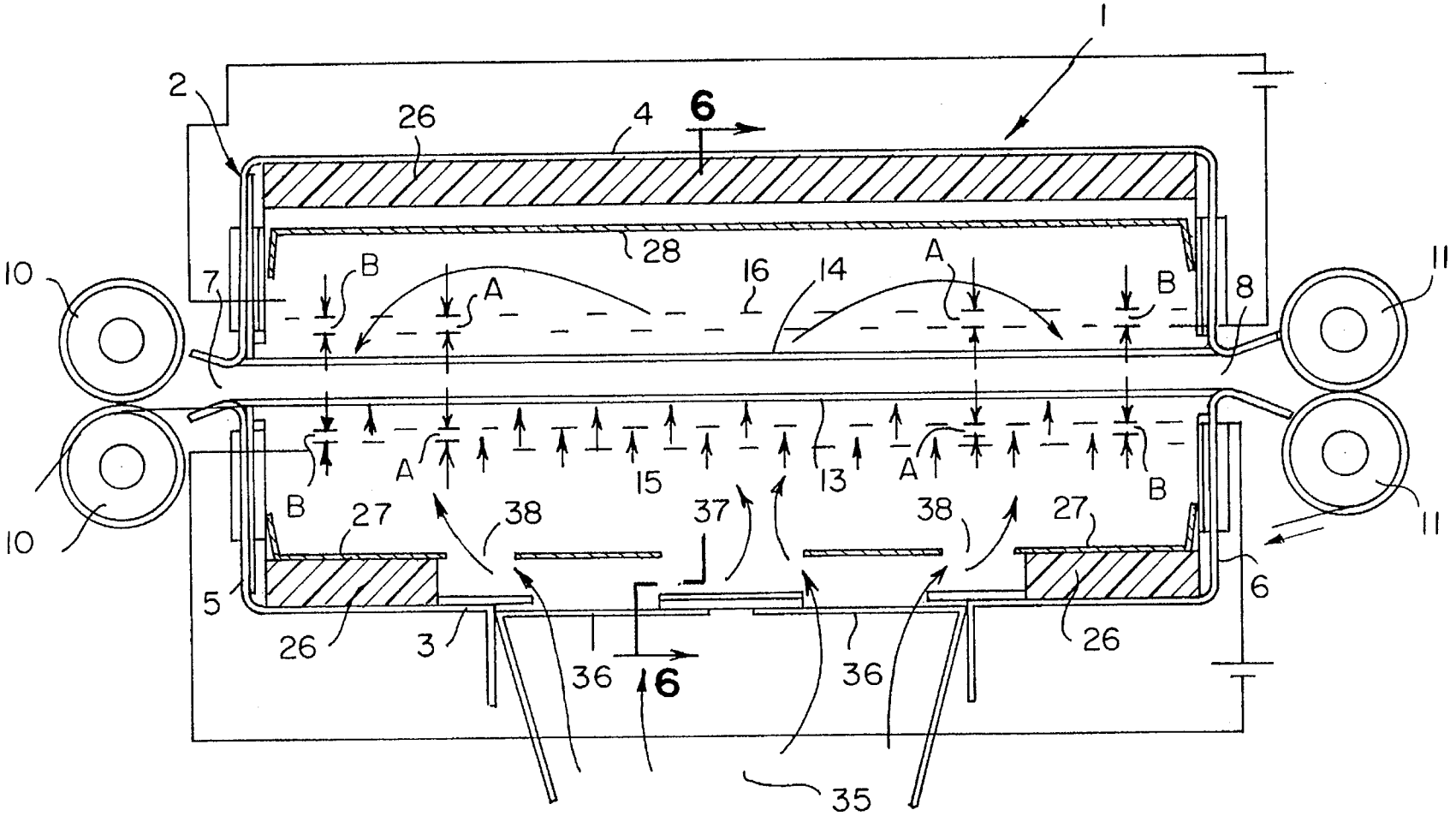
FIG. 2 is a section of a second embodiment of a radiation fixing device according to the invention.
Figure 6:
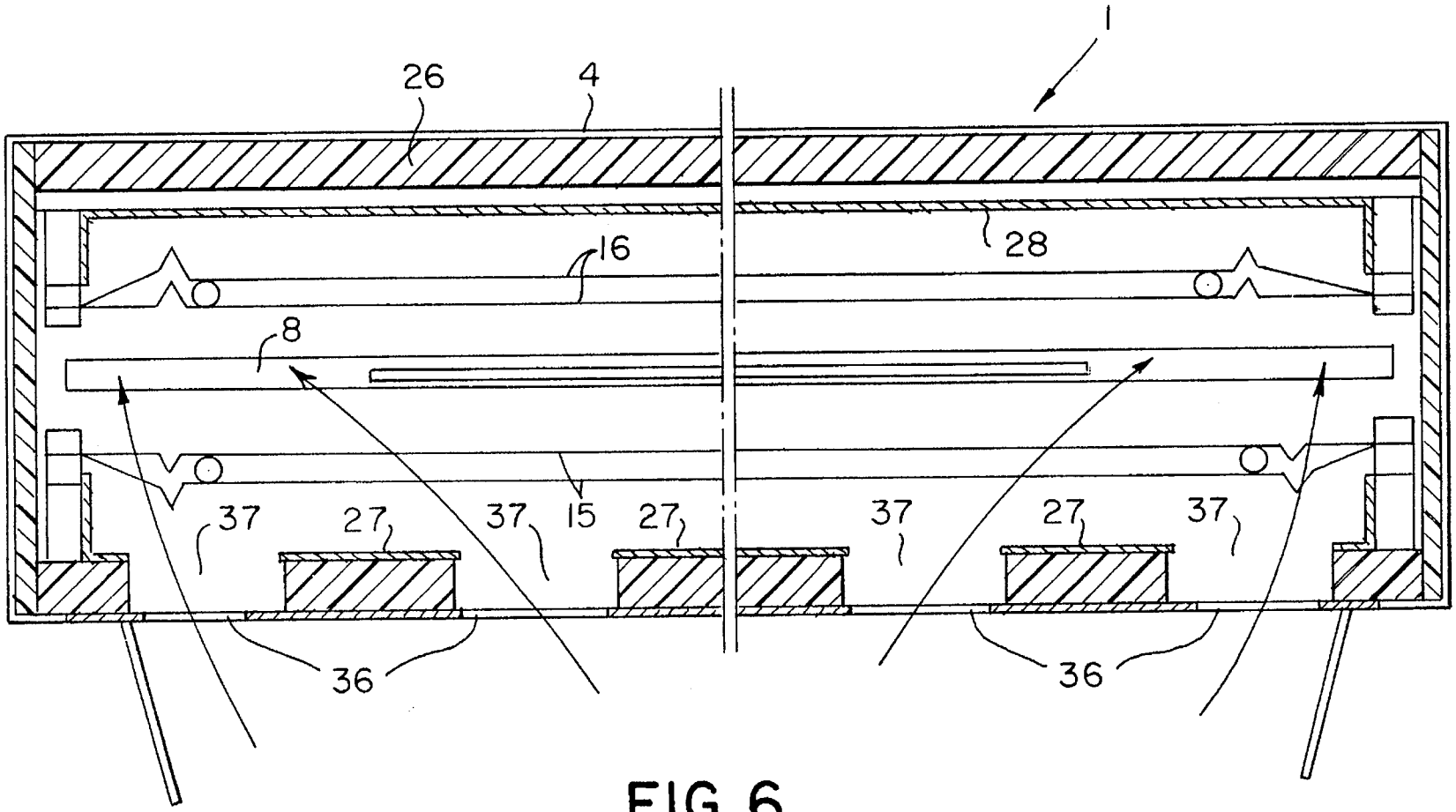
FIG. 6 is a cross-sectional view taken along broken line VI—VI of FIG. 2.

The embodiment of a radiation fixing device according to the present invention shown in FIGS. 2 and 6 has, viewed in the direction of sheet transport, an effective length longer than the effective length of the radiation fixing device shown in FIG. 1, namely approximately 200 mm as opposed to approximately 140 mm. A radiation fixing device with a longer effective length can be operated with a lower temperature of the radiators. Corresponding parts of the radiation fixing devices shown in FIGS. 1, 2, 5 and 6 are indicated by the same reference numbers. An important difference between the two radiation fixing devices is that the radiator lamellae 15 and 16 in the device shown in FIGS. 2 and 6 extend transversely with respect to the direction of sheet transport, the lamellae suspensions lying on both sides of the sheet conveyor path so as to achieve a more effective use of the length of the radiation fixing device in the direction of sheet transport. The lamellae 15 and 16 are each formed from a 9.6 mm wide strip of stainless steel which runs in a meandrous path through the housing 1, the lower radiator being a 0.05 mm thick strip and the upper radiator being a 0.04 mm thick strip of equal length. When connected to 220 V, the lower radiator delivers a power of 970 W and the upper radiator a power of 780 W. The strip sections are staggered alternately over a distance of A of 4 mm in a direction perpendicular to the sheet conveyor path, with the exception of the first three strip sections on sides 5 and 6 which are staggered over a distance B of 2 mm. The pitch between two adjacent strip sections in the direction of sheet transport is 9.2 mm, with the exception of the first three strip sections on sides 5 and 6 of which the pitch is 9.8 mm. The radiator strip has a serration formed by pulling the strip through two gearwheels so as to form an alternative for the two V-shaped grooves 23 and 24 in the radiator lamellae, as shown in FIG. 1.

Figure 7:
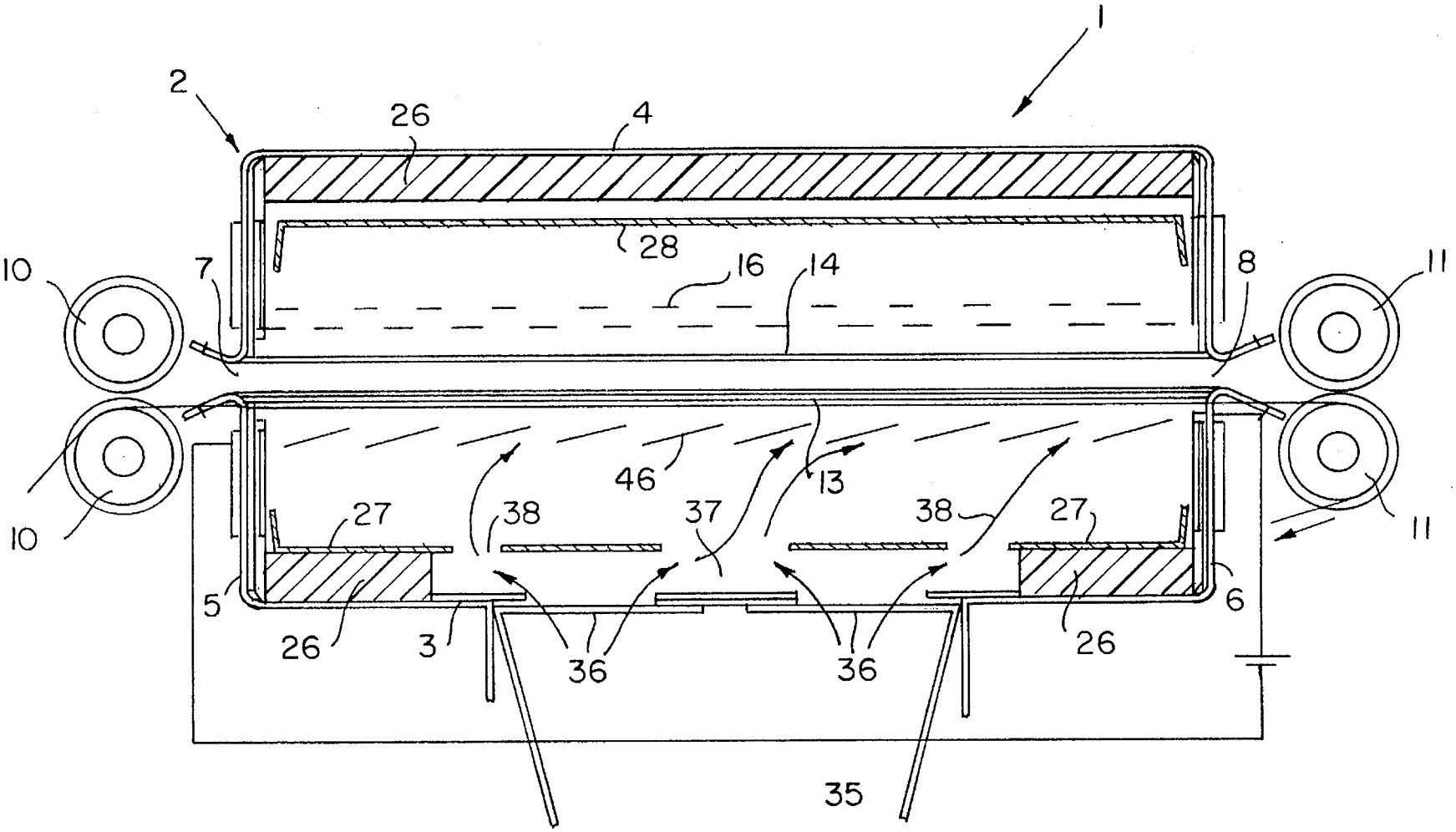
FIG. 7 is a section of a third embodiment of a radiation fixing device according to the invention.

The deviating geometry of the strip sections near to the slot-shaped openings 7 and 8 provides for an increase in localized air flow resistance in a direction perpendicular to the sheet conveyor path, in order to lead the convection air flow in the housing 1 through the center of the housing 1 where the highest temperature prevails in order therefore to increase the effectiveness of natural convection. An effective convection air flow is also achieved if, instead of staggering the lamellae alternately, as shown in FIG. 7 the lamellae 46 are placed in one row at the same acute angle to the conveyor path with the flat sides of the lamellae pointing towards the slot-shaped opening 7. To achieve natural convection, two rows of transversely elongated holes 36 measuring 27.5×50 mm, with a pitch of 65 mm, are formed in the underside 3 of the fixing device shown in FIG. 2 and one row of holes 37 measuring 30×50 mm with a pitch of 65 mm is formed in the reflector plate 27 and on both sides thereof one row of holes 38 measuring 15×15 mm is formed with a pitch of 65/3 mm.

The longer fixing device according to FIG. 2 can be operated at a radiator temperature which is 20° to 30° C. lower than the radiator temperature necessary in a device according to FIG. 1. For a receiving material of 75 gram/m$^2$, a radiator temperature of just under 200° C. is sufficient to reach, during the sheet transit time, a sheet temperature of approximately 100° C. necessary for fixing a powder image on the sheet. For a 110 gram/m$^2$ receiving material, a radiator temperature of just above 200° C. is sufficient.

Figure 3:
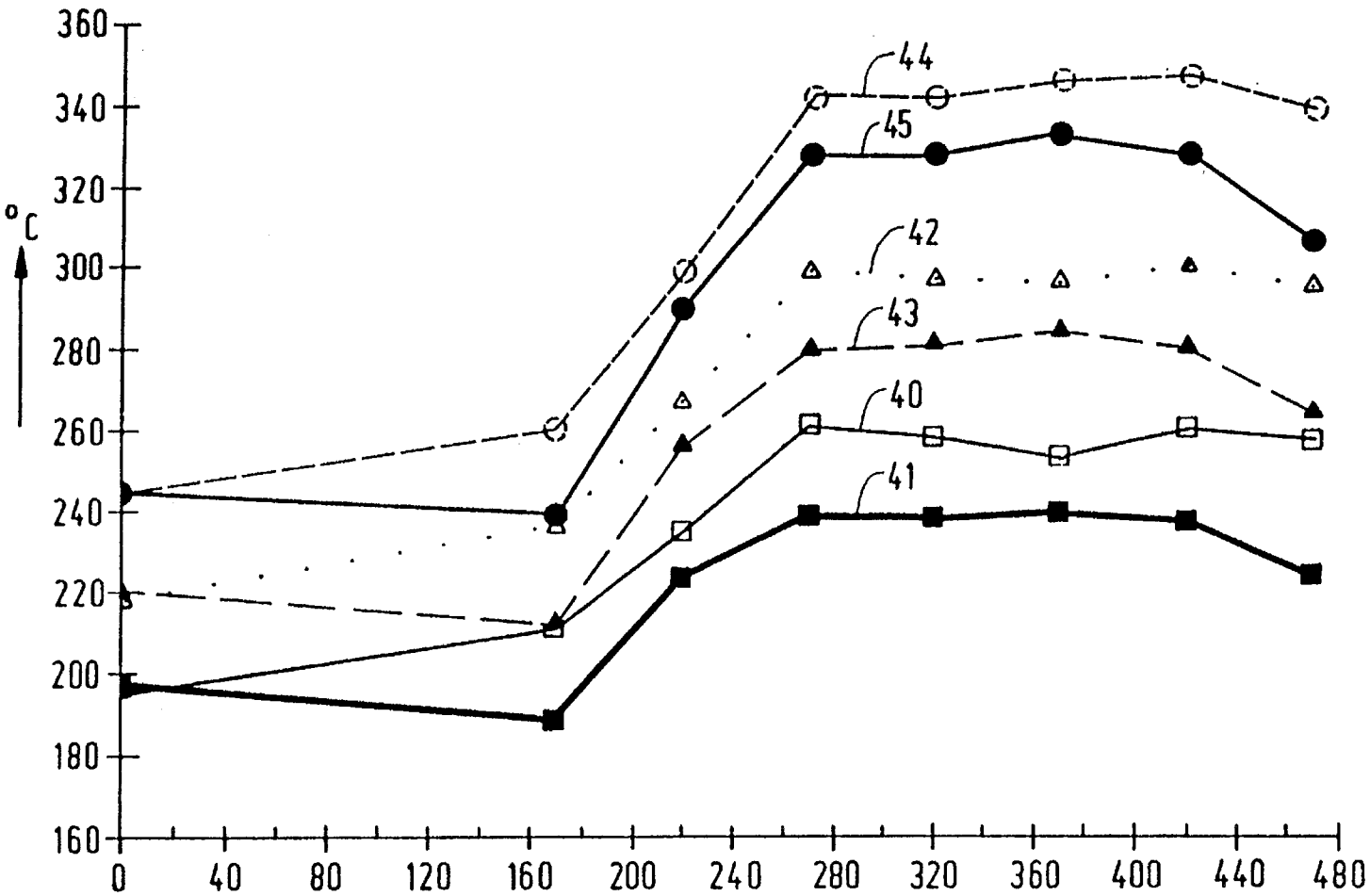
FIG. 3 is a graphic representation of temperature profiles obtained with a first variant of the second embodiment in a direction transverse to the direction of transport of a support through the radiation fixing device.
Figure 4:
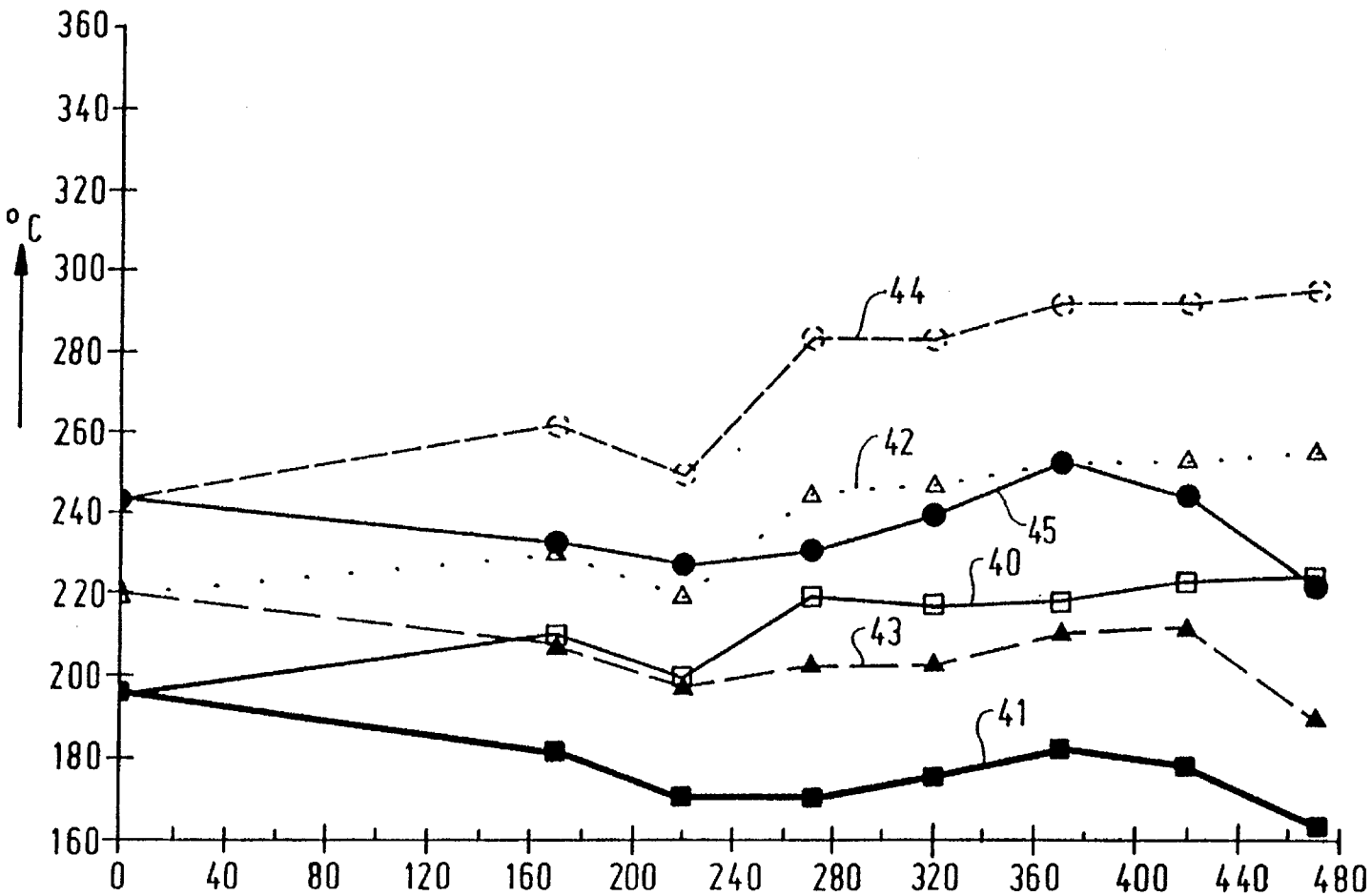
FIG. 4 is a graphic representation of temperature profiles obtained with a second variant of the second embodiment in a direction transverse to the direction of transport of a support through the radiation fixing device.

In FIGS. 3 and 4, the temperatures measured in the lower and upper halves of the fixing device according to FIG. 2 are plotted against the distance in mm measured from the center of the fixing device at which the temperature of concern was measured. The measured values were obtained with 420 mm wide, 110 gram/m$^2$ receiving material fed centrally and with the temperature to which the radiator was regulated set to 200° C., 225° C. and 250° C., respectively. The measured values for the lower half of the fixing device with the temperature adjusted to 200° C. lie on line 40 and for the upper half of the fixing device lie on line 41. The measured values for the lower half of the fixing device with the temperature adjusted to 225° C. lie on line 42 and for the upper half of the fixing device lie on line 43. The measured values for the lower half of the fixing device with the temperature adjusted to 250° C. lie on line 44 and for the upper half of the fixing device lie on line 45. The measured values in FIG. 3 have been obtained with the width of the slot-shaped openings 7 and 8 being about 6 mm, and the measured values in FIG. 4 with a slot width of about 14 mm. The highest temperature measured with a slot width of 6 mm was approximately 340° C. on the side of the housing 1 (FIG. 3) and approximately 300° C. with a slot width of 14 mm (FIG. 4).

The temperature control on the sides of a radiation fixing device achieved by natural convection is preeminently suited for application in a radiation fixing device, the power supply being equally divided over the working width and temperature regulation of the radiators only taking place by means of detection of the temperature of the radiator in the center of the radiation fixing device. By means of natural convection, an air flow is maintained in areas adjacent to a fed sheet, the air flowing from holes 30 and 31 shown in FIGS. 1 and 5, and holes 36, 37 and 38 respectively shown in FIGS. 2 and 6, via the radiator lamellae to the slot-shaped openings 7 and 8. As a result of these rising air flows, enough relatively cool air from the surrounding area can flow into the device via the holes in the underside of the fixing device to maintain the fixing device well below the self-combustion temperature of normally used paper receiving material. In this way, the temperature control on the sides of the fixing device is self-regulated by the sheets fed through, irrespective of the format of the sheets fed in. In addition to being fitted with a safety device at the point of temperature regulation in the center of the housing 1, which is set at 240° C. for example, the radiation fixing device shown in FIGS. 2 and 6 can be fitted with a safety device set at 320° C. for preventing an excessive increase in temperature on the sides of the housing 1.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fixing device for fixing a powder image on a support by means of radiant heat during passage of said image bearing support through a conveyor path extending in a horizontal direction within said device, comprising a housing containing two heat radiators at opposite sides of said conveyor path and having two slot-shaped openings which are disposed opposite each other at opposite ends of said housing and between which said conveyor path extends, and an air duct formed in said housing, said air duct extending across a width of said conveyor path and serving to remove heat from said housing by means of air flowing through said air duct, said air duct forming a fixed open connection between an air inflow opening formed in said housing and situated at a level lower than at least one of said slot-shaped openings and said at least one slot-shaped opening, wherein at least one of said heat radiators located in said air duct, is connected to an external energy source and comprises a plurality of heat-radiating lamellae which are disposed at a short,distance from one another and extend alternately in two planes which are at different distances from said conveyor path.

2. A fixing device according to claim 1, wherein said heat-radiating lamellae are closer together in an area near said slot-shaped opening than in an adjacent area.

3. A fixing device for fixing a powder image on an image-bearing support by means of radiant heat during passage of said image bearing support through a conveyor path extending in a horizontal direction within said device, comprising a housing containing two heat radiators at opposite sides of said conveyor path and having two slot-shaped openings which are disposed opposite each other at opposite ends of said housing and between which said conveyor path extends, and an air duct formed in said housing, said air duct extending across a width of said conveyor path and serving to remove heat from said housing by means of air flowing through said air duct, said air duct forming a fixed open connection between an air inflow opening formed in said housing and situated at a level lower than at least one of said slot-shaped openings and said at least one slot-shaped opening, wherein at least one of said heat radiators located in said air duct is connected to an external energy source and comprises a plurality of closely spaced heat-radiating lamellae which are the same distance from said conveyor path and which form an acute angle therewith.

* * * * *